US005307825A

United States Patent [19]

Smith

[11] Patent Number: 5,307,825

[45] Date of Patent: May 3, 1994

[54] HAIR GROOMING DEVICE

[76] Inventor: Solomon Smith, 511 Coachman Manor, Lindenwold, N.J. 08021

[21] Appl. No.: 3,747

[22] Filed: Jan. 13, 1993

[51] Int. Cl.[5] ..... A45D 24/00

[52] U.S. Cl. ..... 132/200; 132/112; 132/114

[58] Field of Search ..... 132/112, 113, 114, 115, 132/116, 148, 200, 208, 272

[56] References Cited

U.S. PATENT DOCUMENTS

| | | | |
|---|---|---|---|
| 2,897,826 | 8/1959 | Di Vito | 132/114 |
| 3,101,086 | 8/1963 | Di Vito | 132/114 |
| 3,524,088 | 8/1970 | Ryckman, Jr. . | |
| 3,742,964 | 7/1973 | Newbern . | |
| 3,794,050 | 2/1974 | Gallanis et al. . | |
| 3,797,506 | 3/1974 | Reinsch . | |
| 3,840,030 | 10/1974 | Baker . | |
| 3,850,180 | 11/1974 | Ryckman, Jr. et al. . | |
| 3,850,181 | 11/1974 | Baker . | |
| 3,964,501 | 6/1976 | Matchett . | |
| 3,981,275 | 9/1976 | Schimoler . | |
| 4,368,376 | 1/1983 | Andis . | |
| 4,495,958 | 1/1985 | Roeder | 132/113 |
| 4,585,018 | 4/1986 | O'Connor . | |
| 4,592,376 | 6/1986 | Sigmund et al. | 132/112 |
| 4,605,026 | 8/1986 | Nolin | 132/112 |
| 4,656,684 | 4/1987 | Jewett . | |
| 4,676,260 | 6/1987 | Paulhus et al. | 132/112 |
| 4,859,105 | 8/1989 | Davis et al. | 132/112 |
| 4,922,859 | 5/1990 | Durell et al. | 132/114 |
| 4,984,590 | 1/1991 | Bachtell . | |
| 5,035,251 | 7/1991 | Hollenberg et al. | 132/112 |
| 5,067,501 | 11/1991 | Auger | 132/116 |
| 5,078,157 | 1/1992 | Golan et al. . | |
| 5,088,145 | 2/1992 | Whitefield . | |

FOREIGN PATENT DOCUMENTS

| | | | |
|---|---|---|---|
| 0291377 | 9/1953 | Switzerland | 132/20 L |

*Primary Examiner*—Gene Mancene
*Assistant Examiner*—Frank A. LaViola
*Attorney, Agent, or Firm*—Synnestvedt & Lechner

[57] ABSTRACT

Hair grooming devices designed for detangling hair that has been styled into plats, braids, dreadlocks or cornrows and methods for using these devices are provided by the present invention. The device includes a handle portion and a tapered parting member extending longitudinally and transversely from a first end of the handle portion wherein the parting member has at least one transverse tooth extending from the end portion of the parting member. Depending on the requirements of the user, a single tooth or a plurality of teeth are provided in various embodiments of the present device and certain embodiments can be used to apply various hair styling fluids to the hair.

21 Claims, 2 Drawing Sheets

HAIR GROOMING DEVICE

FIELD OF THE INVENTION

This invention relates to a hair grooming device for detangling hair, especially hair which has been styled into plats, braids, dreadlocks, or cornrows.

BACKGROUND OF THE INVENTION

The detangling of hair is a daily problem experienced by many men and women. Detangling of hair is often a time-consuming and painful process for those who have their hair styled in plats, braids, dreadlocks or cornrows. For convenience, the term "plat" is used hereinafter to incorporate hair styled in braids, dreadlocks and cornrows.

The detangling of hair styled in plats is usually accomplished by using the fingers and a comb to slowly attempt to detangle the plat. However, a standard comb or brush is not suited to this purpose and most of the work must be done using the fingers. This is a slow and tedious process and often an attempt to use a comb or brush results in hair breakage, scalp irritation and pain.

While there are a variety of devices available for detangling hair, the vast majority of these devices are primarily intended for detangling straight hair which has been become tangled as a result of washing or styling. These devices are unsuited to the detangling of plats, given the dense, intertwined nature of the hair present in the plats. Ideally, devices used to detangle the hair should provide relatively rapid and pain-free detangling without damage to the scalp or hair. Accordingly, there is a need for a device which is specifically designed for the detangling of hair present in plats.

Previous attempts to design hair grooming devices suitable for detangling hair have often incorporated a pair of parallel combs reciprocating with respect to each other, which serve to detangle the hair as the comb is pulled through the hair. The prior art includes a variety of patents directed to devices which incorporate this parallel comb design U.S. Pat. No. 3,794,050 to Gallanis et al. is directed to a power driven comb for untangling which utilizes a pair of closely spaced comb members which are reciprocated in an out of phase relationship to create a wave motion in hair for the purpose of untangling it. The power-driven comb disclosed in Gallanis et al. is designed to untangle and comb hair without disrupting the curled or styled condition of the hair. U.S. Pat. No. 3,840,030 to Baker is directed to a detangling hair dryer comb wherein the rapid reciprocation of one comb with respect to a fixed straddling comb facilitates detangling of the hair while drying it. U.S. Pat. No. 3,850,180 to Ryckman, Jr. et al. is directed to a powered hair detangling device with a comb arrangement that provides rapid reciprocation of one comb with respect to a fixed straddling comb. This device may include means to dispense a fluid onto the combs and thus into the hair. U.S. Pat. No. 3,850,181 to Baker is directed to an improvement in the device described in U.S. Pat. No. 3,850,180 wherein the improvement is in the design of the movable comb means which reduces the load on the movable comb.

While the above-described patents are generally directed to detangling hair, none are designed for detangling hair which has been platted. In particular, none of these devices is suited to insertion into a plat for detangling of the individual plat as the comb is moved through the hair.

In view of the difficulty in detangling hair which has been platted and the unsuitability of the prior art devices, a need exists for a device that can untangle hair relatively painlessly without damaging the scalp or hair of the user.

SUMMARY OF THE INVENTION

In accordance with the teachings of this invention, a hair grooming device and methods for using this device are provided. The hair grooming device comprises a handle portion and a tapered parting member extending longitudinally and transversely from a first end of a handle portion, wherein the parting member has at least one transverse tooth extending from an end portion of the parting member.

Use of the device and its various embodiments offers a variety of advantages over previously available devices. The device is simple to use, and is able to detangle hair with a minimum of hair breakage and pain. In addition, the device of the present invention is particularly useful for those who have their hair styled in plats. The device is able to enter the woven hair and gradually loosen the plats without the continual snagging that occurs with conventional combs and brushes. In certain preferred embodiments, there is virtually no hair loss because the preferred staggered or nonaligned tooth design does not snag as it is pulled through the hair.

The hair grooming device of the present invention can be used by inserting the end portion of the parting member into the center region of a tangle or plat and guiding the end portion of the parting member in a direction away from the base of the hair. This detangling process is enhanced by rotating the device about the central longitudinal axis of the handle portion.

In certain embodiments, the device of the present invention possesses a cavity in the handle portion, which serves as a reservoir for fluids such as hair styling oils, connected to a lumen, extending to the end portion of the parting member, to permit the user to apply a fluid to the hair as the hair is detangled or styled.

The device of the present invention may possess a single tooth or a plurality of teeth which assist in the detangling of the hair. The length of these teeth can vary and a given device may have teeth of identical or differing lengths In certain other embodiments, a motor is provided which is capable of moving the teeth in a motion which assists in detangling the hair.

Accordingly, a simple and efficient hair grooming device is provided that permits relatively rapid and painless removal of plats and the detangling of hair. Depending on the requirements of the user, a variety of embodiments are disclosed which are suited to different hair styles and different grooming requirements wigs, mustaches, beards and dolls, etc.

BRIEF DESCRIPTION OF THE DRAWINGS

The accompanying drawings illustrate embodiments of the present invention in which.

DETAILED DESCRIPTION OF THE INVENTION

The hair grooming device of the present invention provides a variety of benefits over prior art detangling combs and brushes. The hair grooming device of the present invention enables those who have plats braids, and cornrows, etc., in their hair to remove these plats without damaging their scalp or the hair present in the plat. In part, the advantages offered by the present grooming device are due to the presence of a pointed parting member which is inserted into the tangled hair. The utilization of the pointed parting member avoids the difficulties encountered in inserting a comb or brush into tangled hair and moving the comb or brush through the hair.

Figure 1:
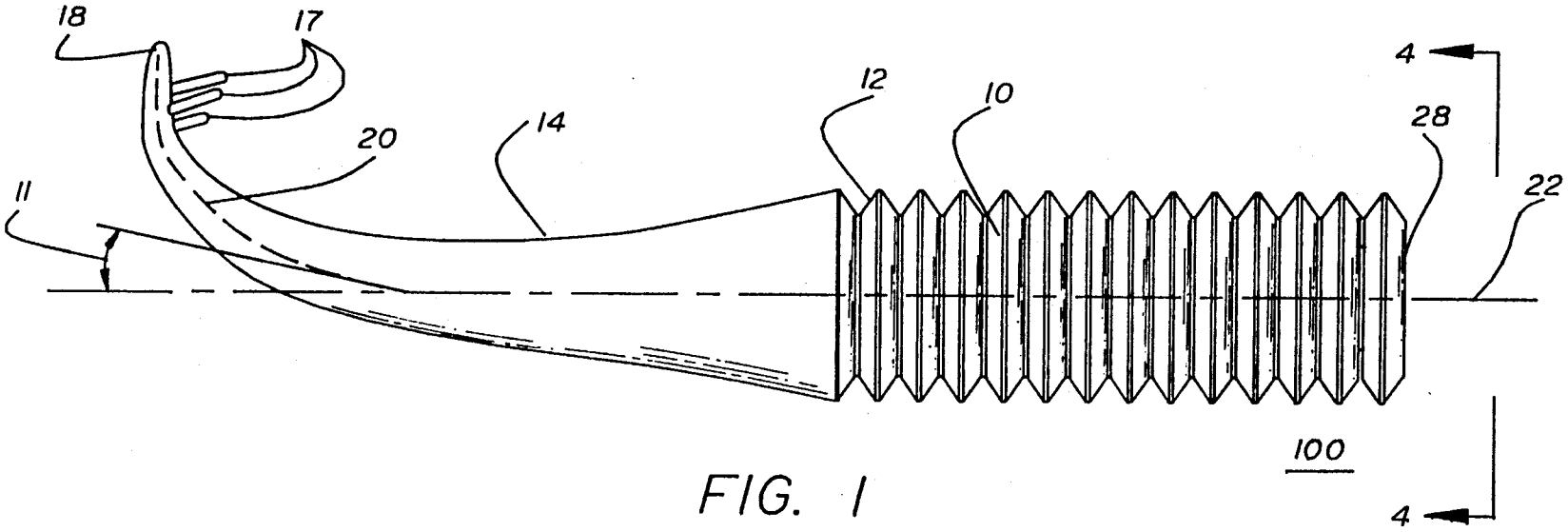
FIG. 1 is a side plan view of the hair grooming device.
Figure 2:
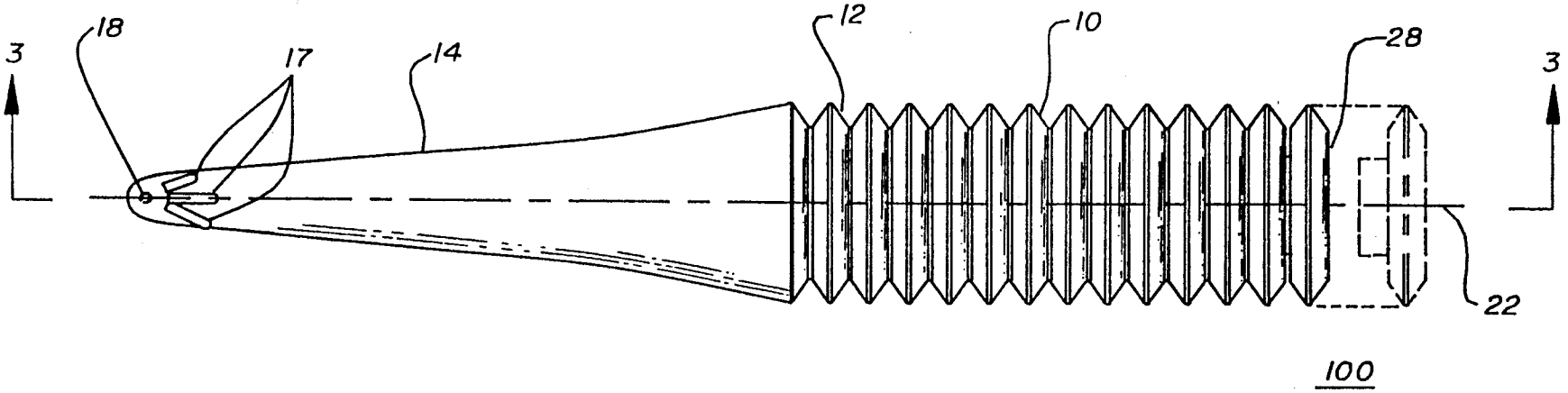
FIG. 2 is a top plan view of the device of FIG. 1.

The term "tangle" as used herein refers to tangled hair as understood to those skilled in the art, as well as hair that is present in a plat, braid, cornrow and other such hairstyles wherein the hair has been arranged in a compact and intertwined manner. The term "hairstyling implements" includes a variety of devices used for the styling of hair including bobby pins, barrettes and other styling implements known to those skilled in the art. The term "styling fluid" refers to a variety of fluids used to set, detangle or style the hair. It is anticipated that hair styling fluids, such as those which contain ingredients such as mineral oil, glycerin, hydrogenated vegetable oil or petroleum will preferably be used in certain embodiments of the present invention to assist in the detangling and/or styling of hair. Referring now to the figures, there is illustrated in FIG. 1 a side plan view of a preferred hair grooming device 100 of the present invention. A handle portion 10 is provided at one end of the device 100, which allows the user to grip it during use. The handle portion 10 optionally contains a cavity which may be used to store hair styling implements or a fluid useful in the styling or detangling of hair. The handle portion 10 may be constructed of a variety of materials including: metal, wood, ceramic, thermoplastic polymers and thermosetting polymers, with and without reinforcements, such as glass fibers.

Disposed on the surface of the handle portion 10 preferably is a gripping aid 12 which helps the user to secure an adequate grip on the device as it is used to remove plats or detangle hair. The structure of the gripping aid can take on any number of forms such as the accordian form illustrated, or such other form as is known in the art.

Disposed on a first end of the handle portion is a tapered parting member 14 which preferably tapers to a pointed tip 18. The pointed tip 18 can range from a sharp, finely pointed tip to a blunt, or snub-nosed tip. In preferred embodiments, the tip is sufficiently pointed to enter densely packed hair or plats, but not so sharp as to create a potential for damaging or penetrating the scalp. It is anticipated that the included angle 11 formed by the intersection of the central longitudinal axis 22 of the handle portion 10 and the central longitudinal axis 20 of the tapered parting member 14 can assume a variety of values from about 20° to about 160° . In preferred embodiments, the angle Il is in a range from about 45° to about 90°.

Disposed on the surface of the end of the tapered parting member 14 is one or more teeth. These teeth may vary in number from about 1 to about 6, depending on the intended use of the grooming device. In a preferred embodiment illustrated in FIG. 1, the device has 3 non-aligned teeth 17. The teeth 17 present on a given device may be of identical or differing lengths For the purposes of grooming short hair, it is anticipated that the teeth will be, in general, shorter than lengths employed in detangling long hair. The teeth may range from about 0.1 to about 1.0 inches in length, preferably about 0.125 to 0.5 inches long, and in the most preferred embodiment about 0.25 inches long. Embodiments of the present invention which incorporate a plurality of teeth have the teeth arranged in a staggered or non-aligned manner. This facilitates the passage of the teeth through the hair present in a plat or braid. In certain other embodiments which are designed to apply hair styling fluids to the hair, the teeth may contain apertures through which a styling fluid can flow for application to the hair. Alternatively, the teeth may be designed of a porous material which permits the styling fluid to leach out from the teeth for application to the hair.

Figure 3:
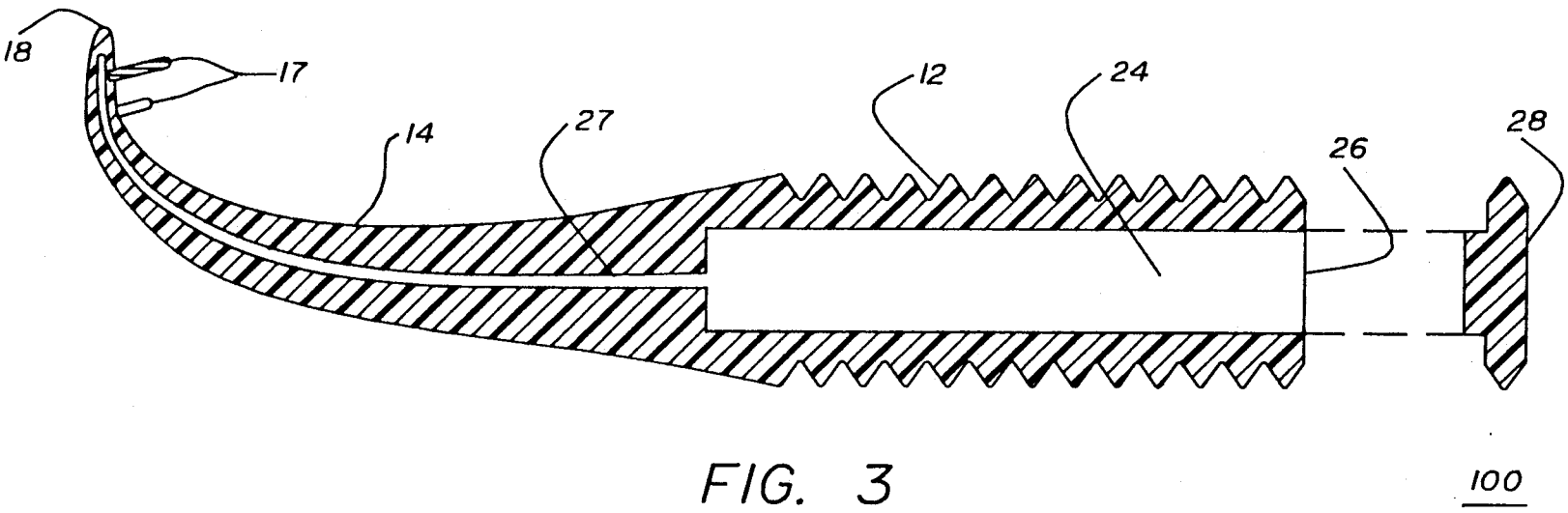
FIG. 3 is a side, cross-sectional view of the device, taken through line 3—3 of FIG. 2.
Figure 4:
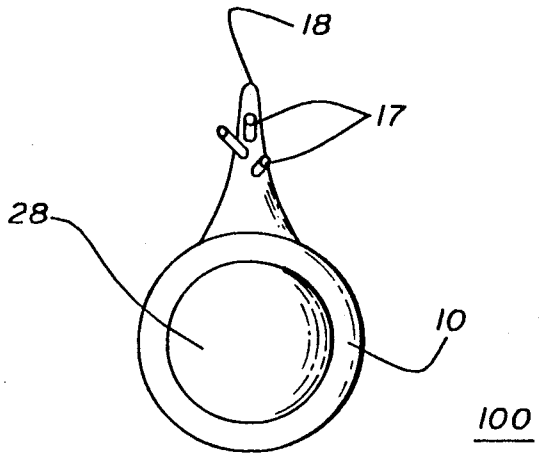
FIG. 4 is an end plan view of the device of FIG. 1.

FIG. 3 illustrates a preferred cavity 24 within the handle portion 10. This cavity 24 may be used to store hair styling implements such as bobby pins and barrettes, or alternatively may serve as a fluid reservoir containing fluid useful in the detangling or styling of hair. Access to the cavity 24 is provided by an opening 26 at a second end of the handle portion 10. The opening 26 may be closed by the use of a cap 28. The cap 28 and opening 26 may be threaded, if desired, to provide a tight, or fluid tight, seal to the cavity 24.

Embodiments of the present hair grooming device which possess the cavity 24 serving as a reservoir for fluids may possess a lumen 27 extending from this reservoir along the longitudinal axis of the parting member 14. The lumen 27 can exit at the tip 18 of the parting member 14 or alternatively can exit at or in near proximity to the teeth 17. In certain embodiments, the lumen 27 may branch and enter the teeth 17 and exit at the tip of the teeth via a secondary lumen, or set of lumens exiting through the teeth 17. Alternatively, the lumen 27 may exit at the base of teeth 17 and the teeth can be constructed of a porous material for receiving and distributing the fluid in the hair.

It is also possible for the device of the present invention to contain a suitable power means which is capable of moving the teeth 17 and/or the tapered parting member 14 in a motion designed to remove plats or detangle the hair, for example. Preferably, in powered embodiments of the present invention, a motor and a battery supply could be located in the cavity 24 present in the handle portion 10. Access to the cavity provided by the opening 26 would allow replacement and installation of batteries. The motor means could be designed to move the teeth by a transmission means such as a flexible geared drive shaft or belt driven device of the type used in mechanical tooth brushes, such as disclosed in U.S. Pat. Nos. 3,524,088 or 5,088,145, and the like. This transmission means would follow the longitudinal axis of the tapered parting member and terminate at the end portion of the parting member. At this terminus, the transmission means would engage a series of gears, or the like, capable of moving the teeth together, or independently. Movement of the teeth would be initiated by activating a button or switch disposed on the exterior surface of the device which is capable of completing a circuit which supplies the electrical current to the motor.

The power means employed by the device may be a plug-in type which utilizes house current or a rechargeable battery type. The battery type version of the powered embodiment of the device is preferred for safety considerations when grooming wet hair.

Although various embodiments have been illustrated, this was for the purpose of describing, but not limiting the invention. Various modifications, which will become apparent to one skilled in the art, are within the scope of the invention described in the attached claims.

LIST OF REFERENCE NUMERALS

10—Handle Portion
11—Included Angle
12—Gripping Aid
14—Tapered Parting Member
17—Teeth
18—Pointed Tip
20—Central Longitudinal Axis of Tapered Parting Member
22—Central Longitudinal Axis of Handle Portion
24—Cavity
26—Opening
27—Lumen
28—Cap

What is claimed is:

1. A hair grooming device comprising a handle portion and a tapered parting member extending longitudinally and transversely from a first end of said handle portion, said parting member having a plurality of teeth in which at least one tooth is in a plane separate from a plane through the parting member, said teeth extending from an end portion of said parting member wherein said end portion of said parting member forms a pointed tip.

2. The grooming device of claim 1, wherein said parting member comprises an arcuate portion.

3. The grooming device of claim 2, wherein said parting member has two to six teeth.

4. The grooming device of claim 3, wherein said parting member has three teeth.

5. The grooming device of claim 1, wherein said handle portion comprises a gripping aid on the surface of said handle portion.

6. The grooming device of claim 1, wherein said teeth are from about 0.1 to about 1.0 inches long.

7. The grooming device of claim 6, wherein said teeth are from about 0.125 to about 0.5 inches long.

8. The grooming device of claim 7, wherein said teeth are about 0.25 inches long.

9. The grooming device of claim 1, wherein the central longitudinal axis of said tapered parting member is disposed at an included angle of from about 20° to about 160° from the central longitudinal axis of said handle portion.

10. The grooming device of claim 1, wherein the longitudinal axis of said tapered parting member is disposed at an included angle of from about 45° to about 90° from the central longitudinal axis of said handle portion.

11. The grooming device of claim 1, wherein said handle portion contains a cavity therein and an opening at a second end of said handle portion, said device further including a cap which may be used to selectively close said opening.

12. The grooming device of claim 14, wherein said cavity contains a hair styling fluid.

13. The grooming device of claim 12, comprising a lumen extending from said reservoir along the longitudinal axis of said parting member and exits at the end portion of said parting member.

14. The grooming device of claim 13, wherein said lumen exits through said teeth.

15. The grooming device of claim 13 wherein said lumen exits through the tip of said parting members.

16. The grooming device of claim 12, wherein said fluid is oil.

17. The grooming device of claim 11, wherein said cavity is large enough for the storage of hair styling implements.

18. A grooming device comprising a handle portion and an arcuate tapered parting member extending longitudinally from a first end of said handle portion, wherein the longitudinal axis of said tapered parting member is disposed at an included angle of about 20° to about 160° from the central longitudinal axis of said handle portion said parting member having at least one to about six teeth wherein at least one tooth is in a plane separate from a plane through the parting member and said teeth are about 0.25 to about 0.5 inches in length extending transversely from an end portion of said parting member, said parting member tapering to a pointed tip.

19. A method of grooming hair comprising:

providing a grooming device including a handle portion and a tapered parting member extending longitudinally from a first end of said handle portion, said parting member having a plurality of teeth in which at least one tooth is in a plane separate from a plane through the parting member, said teeth extending from an end portion of said parting member, said end portion of said parting member forming a pointed tip;

inserting said end portion of said parting member into a center region of a tangle, plat or braid, and guiding said end portion of said parting member in a direction away from the base of the hair and combing said hair with said tooth.

20. The method of claim 19 further comprising rotating the grooming device about the central longitudinal axis of the handle portion as said end portion is guided in a direction away from the base of the hair.

21. A method of grooming hair comprising:

providing a grooming device including a handle portion and an arcuate tapered parting member extending longitudinally from a first end of said handle portion, said handle portion including a reservoir cavity containing styling fluid; said device further including a lumen extending from said reservoir cavity along a longitudinal axis of said parting member and exiting near the end portion of said parting member, said parting member having a plurality of teeth in which at least one tooth is in a plane separate from a plane through the parting member, said teeth extending from said end portion;

inserting said end portion of said parting member into the center region of a tangle, plat or braid, and guiding said end portion in a direction away from the base of the hair; and applying said styling fluid to the hair through said lumen.

* * * * *